US007707695B2

(12) United States Patent
Dubois

(10) Patent No.: US 7,707,695 B2
(45) Date of Patent: May 4, 2010

(54) ADJUSTABLE LOCKING MECHANISM FOR PROTECTIVE HEAD GEAR

(75) Inventor: Lucie Dubois, Berthierville (CA)

(73) Assignee: Degil Safety Products (1989) Inc., Woodbridge, Ontario (CA)

( * ) Notice: Subject to any disclaimer, the term of this patent is extended or adjusted under 35 U.S.C. 154(b) by 222 days.

(21) Appl. No.: 11/590,751

(22) Filed: Nov. 1, 2006

(65) Prior Publication Data

US 2008/0109947 A1 May 15, 2008

(51) Int. Cl.
*A42B 1/22* (2006.01)
*A42B 3/04* (2006.01)
*A44B 21/00* (2006.01)

(52) U.S. Cl. ..... 24/68 B; 2/418

(58) Field of Classification Search ..... 24/68 B; 74/10.39, 10.41; 16/441, 414, DIG. 30; 200/341, 200/538, 539; 2/418
See application file for complete search history.

(56) References Cited

U.S. PATENT DOCUMENTS

| | | | | | |
|---|---|---|---|---|---|
| 1,516,152 | A * | 11/1924 | Dumont | 16/414 |
| 2,603,325 | A * | 7/1952 | Pickard | 74/548 |
| 4,779,305 | A * | 10/1988 | Gorsek | 16/441 |
| 4,942,628 | A | 7/1990 | Freund | |
| 5,333,329 | A | 8/1994 | Hong | |
| 5,373,588 | A | 12/1994 | Hede et al. | |
| 5,950,245 | A * | 9/1999 | Binduga | 24/68 B |
| 6,508,144 | B1 * | 1/2003 | Vendetti et al. | 74/553 |
| 6,708,376 | B1 * | 3/2004 | Landry | 24/68 B |
| 7,000,262 | B2 * | 2/2006 | Bielefeld | 24/68 B |
| 2004/0060154 | A1 | 4/2004 | Landry | |
| 2005/0081331 | A1 * | 4/2005 | Forsythe | 16/110.1 |

FOREIGN PATENT DOCUMENTS

| | | |
|---|---|---|
| CA | 2280851 | 10/1998 |
| CA | 2286993 | 10/1998 |
| CA | 2405926 | 4/2004 |

OTHER PUBLICATIONS

Degil Safety.Com home page, printed from www.degilsafety.com/canadian/index.php, 2 pgs, Nov. 21, 2005.
Degil Safety.Com Product Catalogue, Category: Hard Hats, printed from www.degilsafety.com/canadian/products.php?country=canadian&id=42, 2 pgs, Nov. 21, 2005.

(Continued)

*Primary Examiner*—Robert J Sandy
(74) *Attorney, Agent, or Firm*—Hasse & Nesbitt LLC; Daniel F. Nesbitt

(57) ABSTRACT

A locking mechanism for a headgear suspension using two racks, a pinion, a driver and a lockable knob. The two racks are positioned on the suspension such that they overlap and permit engagement of the gears on the driver with teeth on the rack such that when the lockable knob is in the unlocked position the driver tightens or loosens the racks to adjust the diameter of the suspension to the user's head size. The lockable knob of the invention operates on a pull, rotate, push and lock system. There are no metal parts and the lockable knob can be locked and unlocked with one hand, by the user.

8 Claims, 14 Drawing Sheets

OTHER PUBLICATIONS

North Safety Products, Series or Product No. - A79RS - PEAK, printed from www.northsafety.com/TiggerWorkflow.aspx?WorkflowModuleGUID=9eaed58a-5abe-436b-b398-6854e8a48bcd&CountryCode=ca&LanguageCode=en &ProductItemID =53&ReuseToken=True, 1 pg, 2004.

North Safety Products, Series or Product No. - A79RNS - PEAK, printed from www.northsafety.com/TriggerWorkflow.aspx?WorkflowModuleGUID-9eaed58a-5abe-436b-b398-6854e8a48bcd&CountryCode=ea&LanguageCode=en &ProductItemID =52&ReuseToken=True, 1 pg, 2004.

Jackson Products. 391 Head Hugger Suspension, 2006 Jackson Products, printed from www.jacksonproducts.com/prodGroup.aspx?brandCode=JP&catId=2&subCatId=4&pgId=14. 2pgs, Mar. 24, 2006.

MSA North America, 1-Touch Suspension, printed from www.msanet.com/catalag/product18043.html, 3 pgs, Jan. 15, 2005.

Google search results for "degil PRPL" printed from www.google.ca on Oct. 31, 2006, 1 pg.

Hard-Hat Ratcheting - Archives - ISHN, printed from www.ishn.com/copyright/ae127af2e71c7010VgnVCM100000f932a8c0, 1 pg, posted Oct. 1, 2005.

Kit Care Corporation Catalogue 2004; Cap Style Full Brim Style (product information), p. 12; North Head Protection (product information), pp. 269-272. (5 pages), 2004.

MSA The Safety Company, bulletin, I-Touch™ Suspension (product information), Sep. 2006. (1 page).

MSA The Safety Company, bulletin, Suspension 1-Touch$^{MC}$ (product information-French), Mar. 2006. (1 page).

North Safety Products Catalogue (Belgium), PR date May 2006, 24 pages. (Note: North A79 and A79R product information on p. 19).

* cited by examiner

ADJUSTABLE LOCKING MECHANISM FOR PROTECTIVE HEAD GEAR

FIELD OF THE INVENTION

This invention relaxes to safety headgear such as helmets and visors with adjustable lockable suspensions and specifically to a mechanism for adjusting the size of the suspension to fit a user's head and a locking mechanism to easily and readily secure the fit.

BACKGROUND OF THE INVENTION

Helmets or visors with suspension systems to secure a helmet or visor to a user are used in a number of industries as protective headgear for workers and drivers of vehicles such as motorcycles and snowmobiles.

Suspension systems and mechanisms for adjusting and mechanisms for locking them are known in the art. Examples include those disclosed in U.S. Pat. No. 4,942,628 issued on Jul. 24, 1990 in the name of Freund. Another example is US Patent Application 2004/0060154 published Apr. 1, 2004 in the name of Landrey.

SUMMARY OF THE INVENTION

In accordance with an aspect of the present invention there is provided a lockable knob, comprising:

a support;

a knob rotatably mounted on said support;

one of said knob and said support having a radially directed protuberance and another of said knob and said support having a resilient portion which is resiliently deflected over said protuberance when said knob is axially displaced from a first axial position whereat said resilient portion is on one side of said protuberance to a second axial position whereat said resilient portion is on an opposite side of said protuberance;

said support having a locking feature;

said knob having a complementary locking feature for locking to said support locking feature when said knob is in said first axial position, whereby said knob is rotatable only when in said second axial position.

In accordance with a further aspect of the present invention there is provided a suspension system for a helmet, comprising:

a housing;

a suspension having a rack at either end overlapping within said housing;

a pinion extending within said housing and meshing with each said rack;

a driver rotatably supported on said housing and telescopingly receiving a drive end of said pinion;

one of said housing and said driver having a radially directed protuberance and another of said driver and said housing having a resilient portion which is resiliently deflected over said protuberance when said driver is axially displaced from a first axial position whereat said resilient portion is on one side of said protuberance to a second axial position whereat said resilient portion is on an opposite side of said protuberance;

said housing having a locking feature;

said driver having a complementary locking feature for locking to said housing locking feature when said driver is in said first axial position.

In one embodiment of the present invention, there is provided a suspension system wherein said radially directed protuberance comprises a lip circumferentially extending about an annulus of said housing.

In another embodiment of the present invention, there is provided a suspension system wherein said resilient portion comprises a resilient leg depending from said driver having a radially inwardly directed foot.

In accordance with a further aspect of the present invention there is provided a method for adjusting and locking a headgear suspension, the method comprising the steps of unlocking said suspension by pulling a knob of the present invention to deflect said resilient portion over said protuberance to axially displace said knob from a first axial position on one side of said protuberance to a second axial position whereat said resilient portion is on an opposite side of said protrusion permitting free rotation of said resilient portion in said second axial position but not in said first axial position.

In accordance with a further aspect of the present invention there is provided a method for adjusting and locking a headgear suspension, the method comprising the steps of unlocking said suspension by pulling a lockable knob of the present invention to deflect the resilient portion over the protuberance to axially displace the knob from a first axial position on one side of the protuberance to a second axial position whereat the resilient portion is on an opposite side of the protrusion permitting free rotation of the resilient portion in the second axial position but not in the first axial position.

These and other features, aspects and advantages of the invention will become evident to those skilled in the art from a reading of the present description.

BRIEF DESCRIPTION OF THE DRAWINGS

The embodiments of the invention are described in the detailed description which follows. Like parts are identified by like reference numbers.

DETAILED DESCRIPTION OF THE INVENTION

Figure 1:
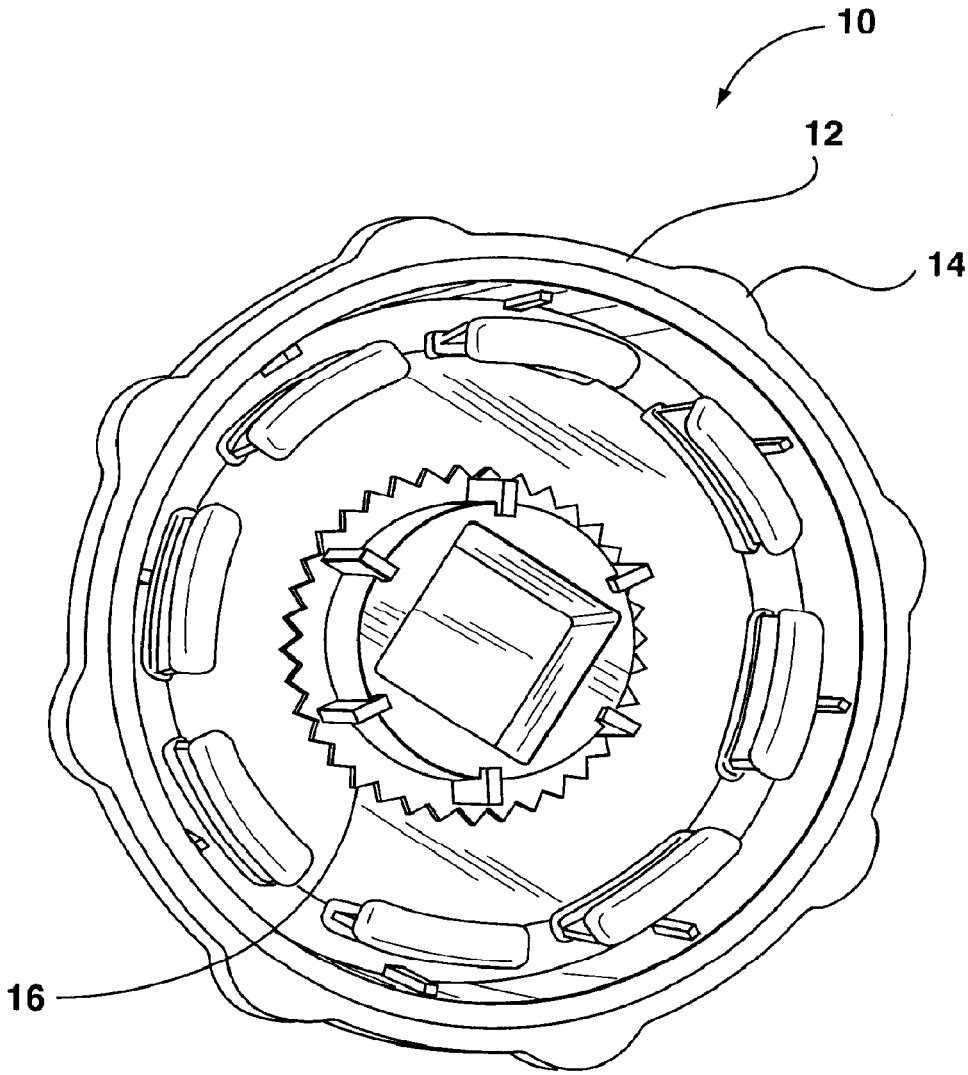
FIG. 1 is a photograph of one embodiment of a bottom plan view of a knob or cap portion of the locking mechanism of the invention.

The present invention provides a locking mechanism for a headgear suspension. The locking mechanism of the invention incorporates a ratchet system with two racks, a driver and a pinion.

Applications for the suspension headgear locking mechanism of the present invention include hard hats, safety hats, bump hats and any article which uses or requires an adjustable suspension as is commonly used in headgear.

The invention relates to a lockable knob for a locking mechanism used on a suspension. The invention further relates to the locking mechanism as a whole which incorporates the lockable knob.

The knob comprises a cap 10 which fits over a head 20 on a support 22. The head can take on various shapes as illustrated in FIGS. 4-11, 12A, 12B, 12C, 13 and 14 as compared to FIGS. 15A and 15B. In FIGS. 4-11, 12A, 12B, 12C, 13 and 14 the head portion 20 is stellate 18 but in FIGS. 15A and 15B the head pinion 78 is round and even. The cap 10 is designed to engage the head with a generally snug fit between the cap 10 and the head 20. The lockable knob comprises a cap portion 10 which engages with a head 20 and can be moved from an unlocked position where the cap 10 is rotatable on the head 20 to a locked position where the can is locked and cannot rotate.

The knob and head are engaged to enable the two parts to be turned or rotated together during the rotation to enlarge or narrow the overall circumference of the headgear suspension.

Figure 3:
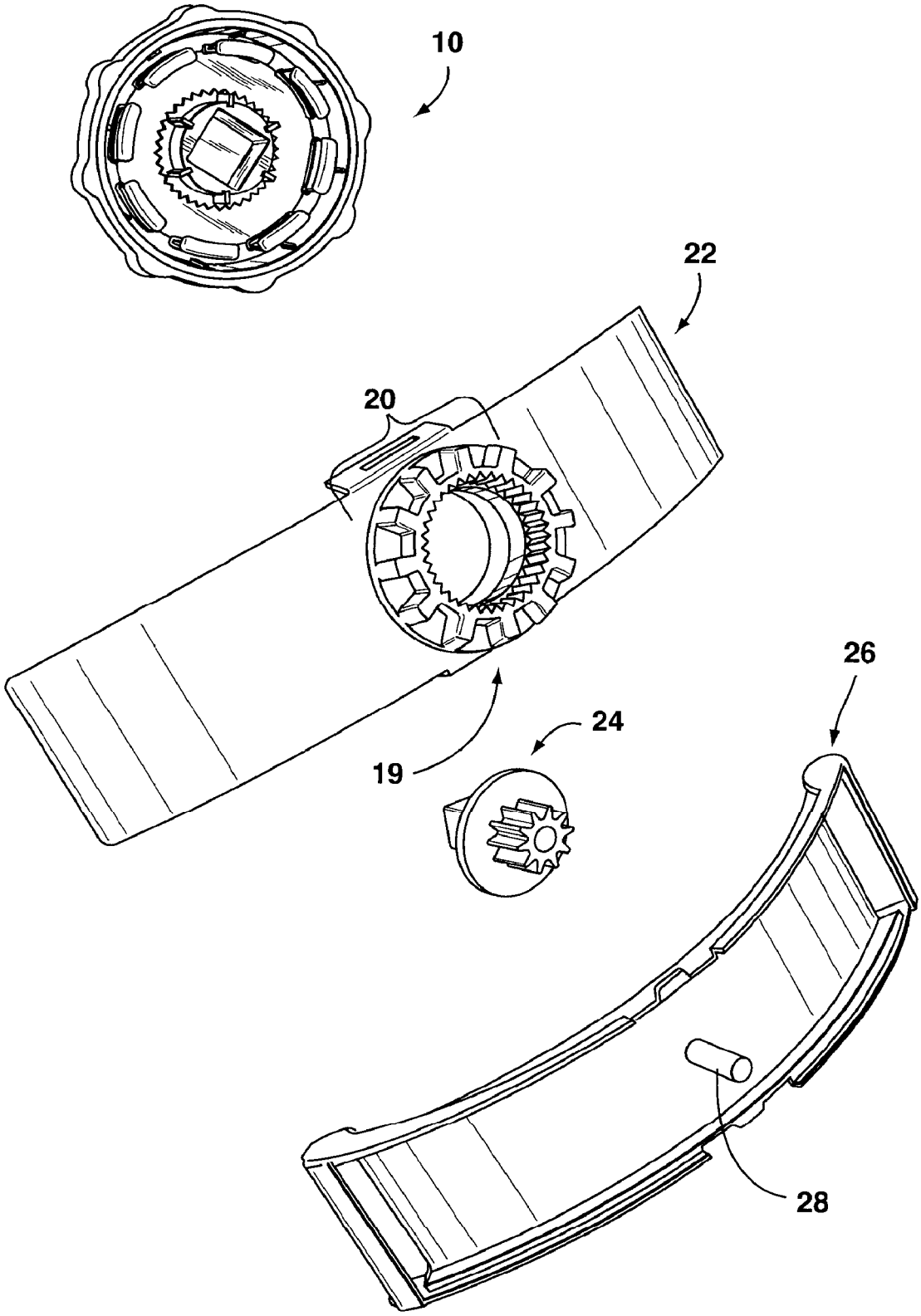
FIG. 3 illustrates a photograph of four parts of the invention, including a bottom perspective view of a knob or cap 10 portion, a top perspective view of a support 22, a driver 24 and a housing 26 of the locking mechanism of the invention.
Figure 6:
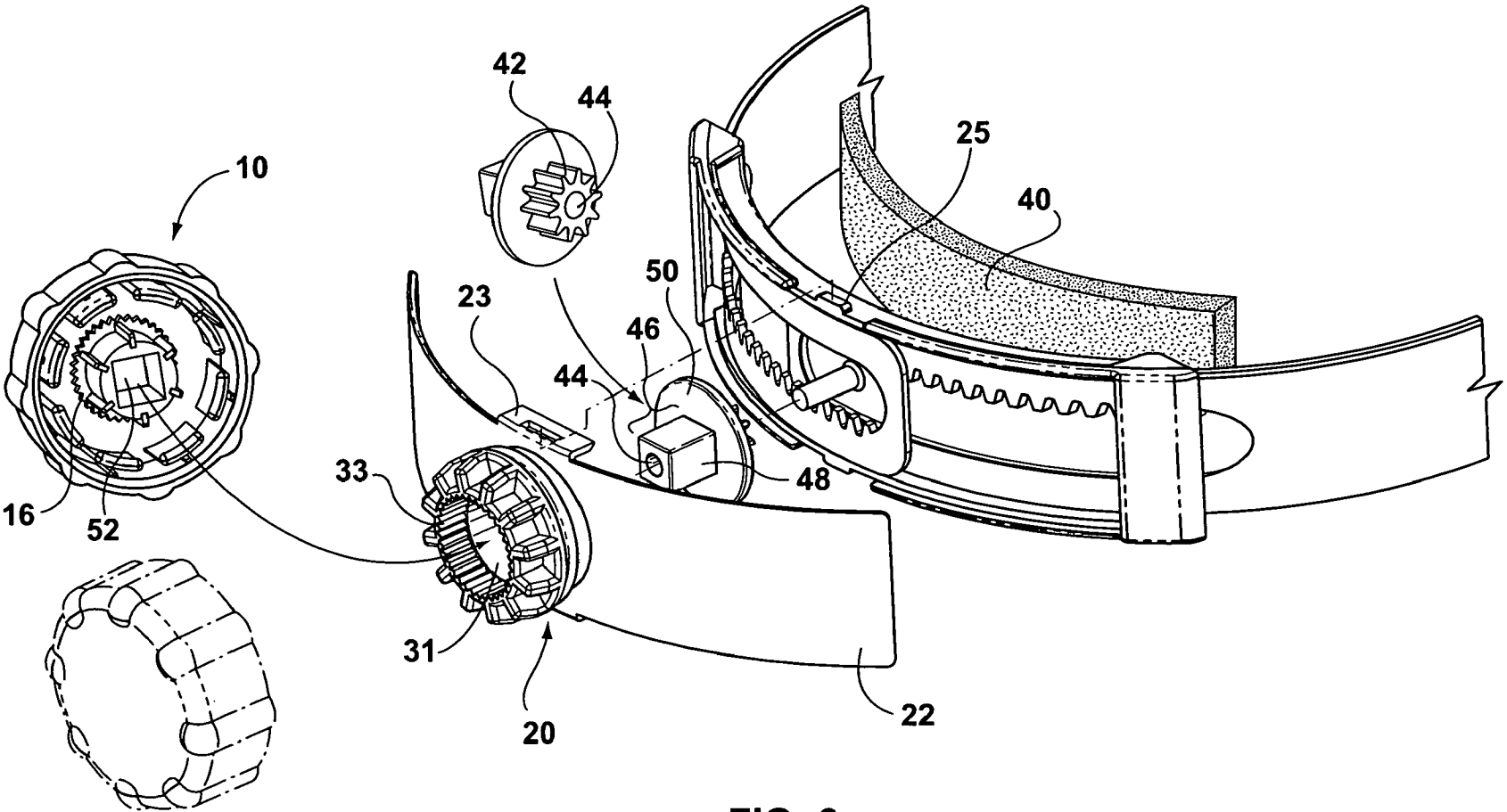
FIG. 6 is another exploded view of a locking mechanism, 2 racks and partial headgear suspension of an embodiment of the invention.
Figure 8:
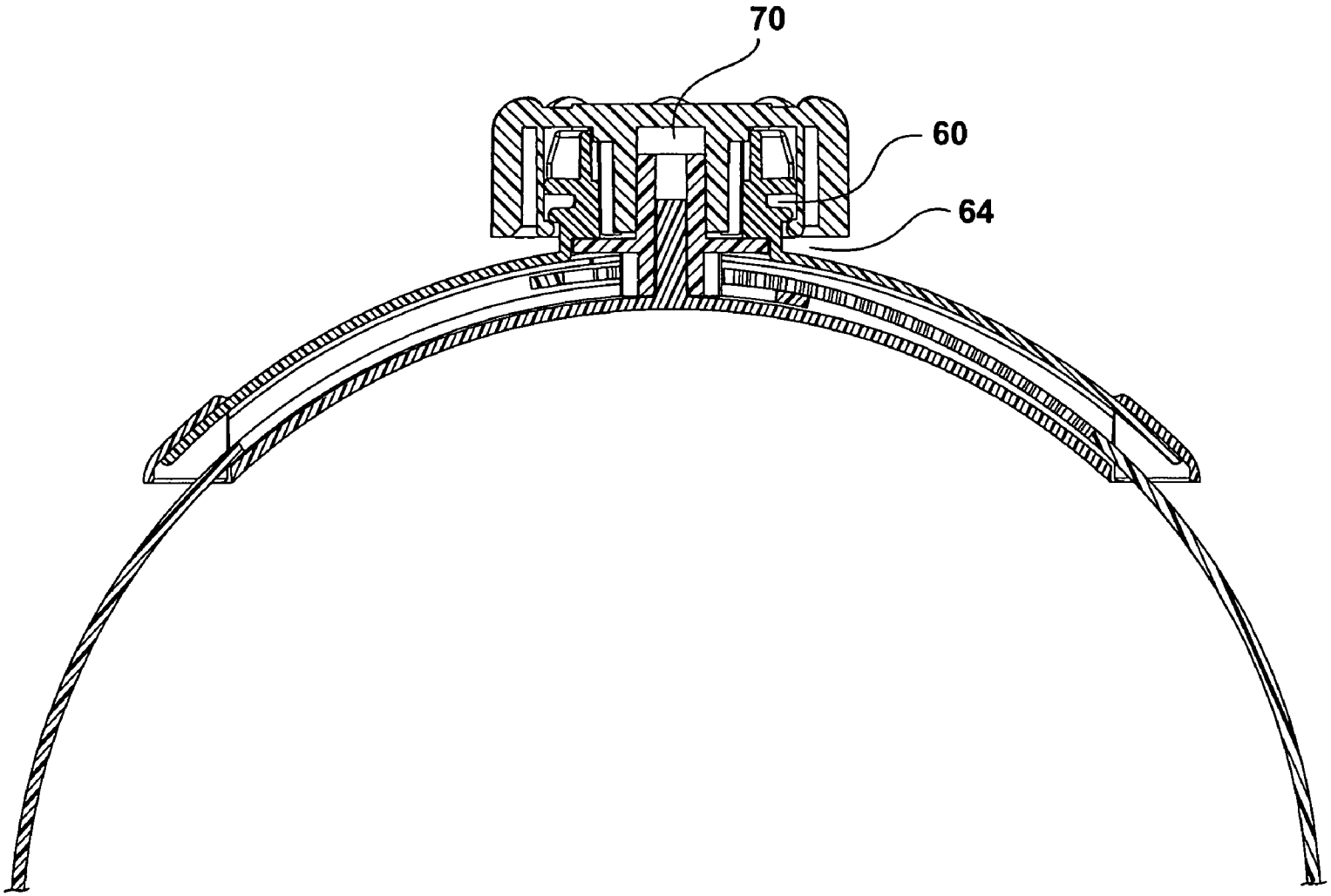
FIG. 8 is a plan section illustrating an embodiment of the invention in a locked on closed position.
Figure 9:
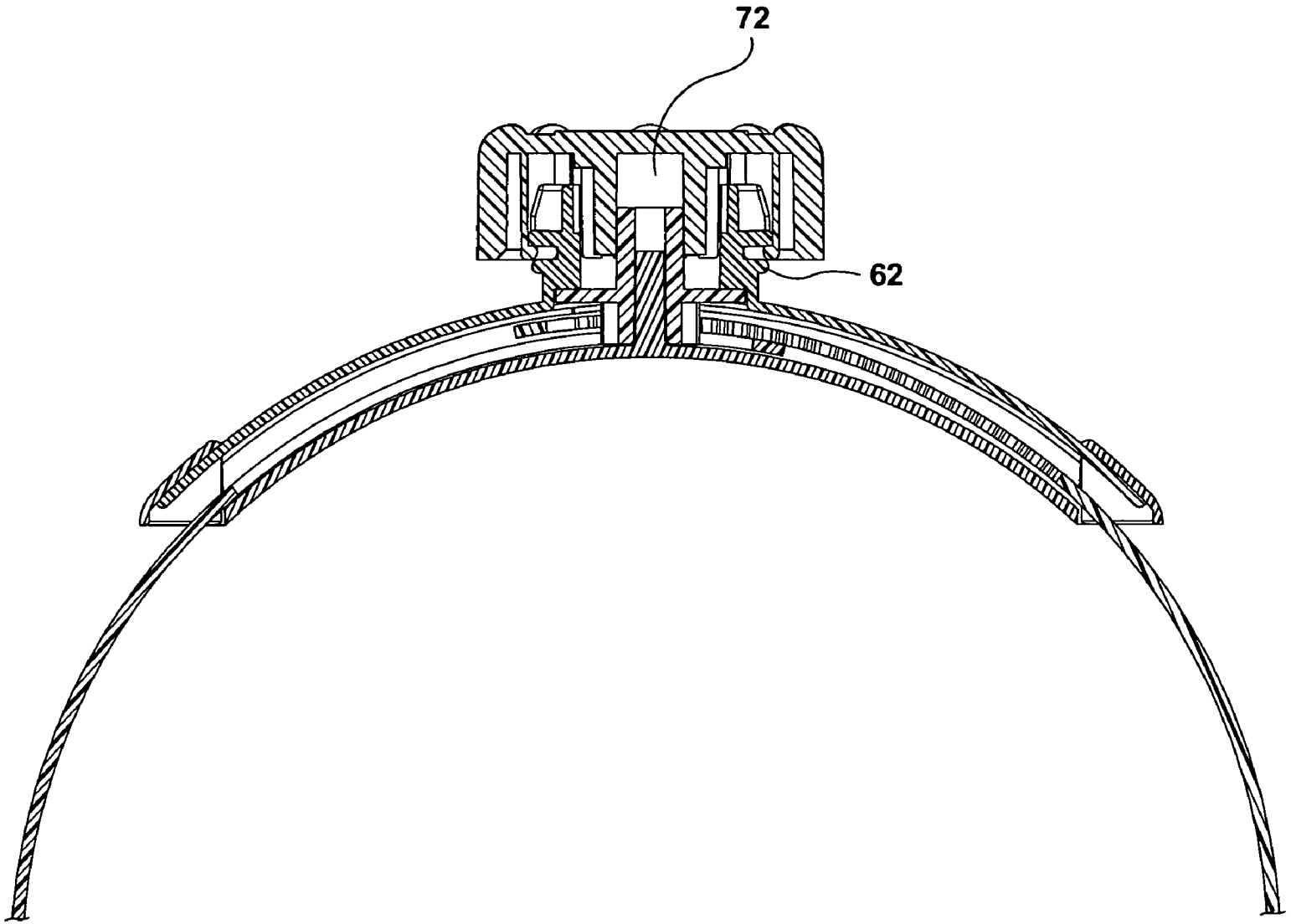
FIG. 9 is a plan section illustrating an embodiment of the invention in an unlocked or open position.
Figure 15A:
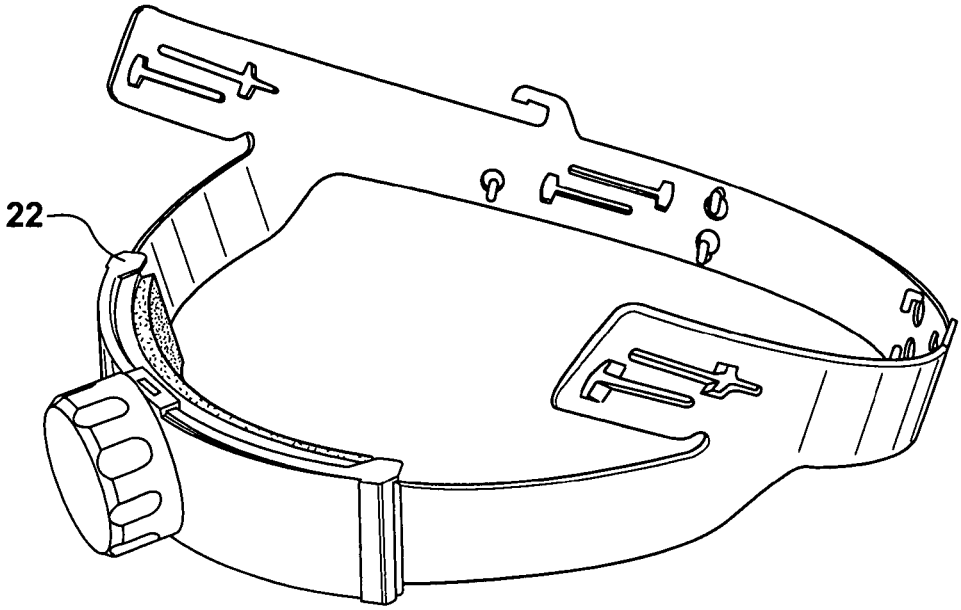
FIG. 15A is an assembled perspective view of attached illustrating a modified cap arrangement with the knob in place.
Figure 15B:
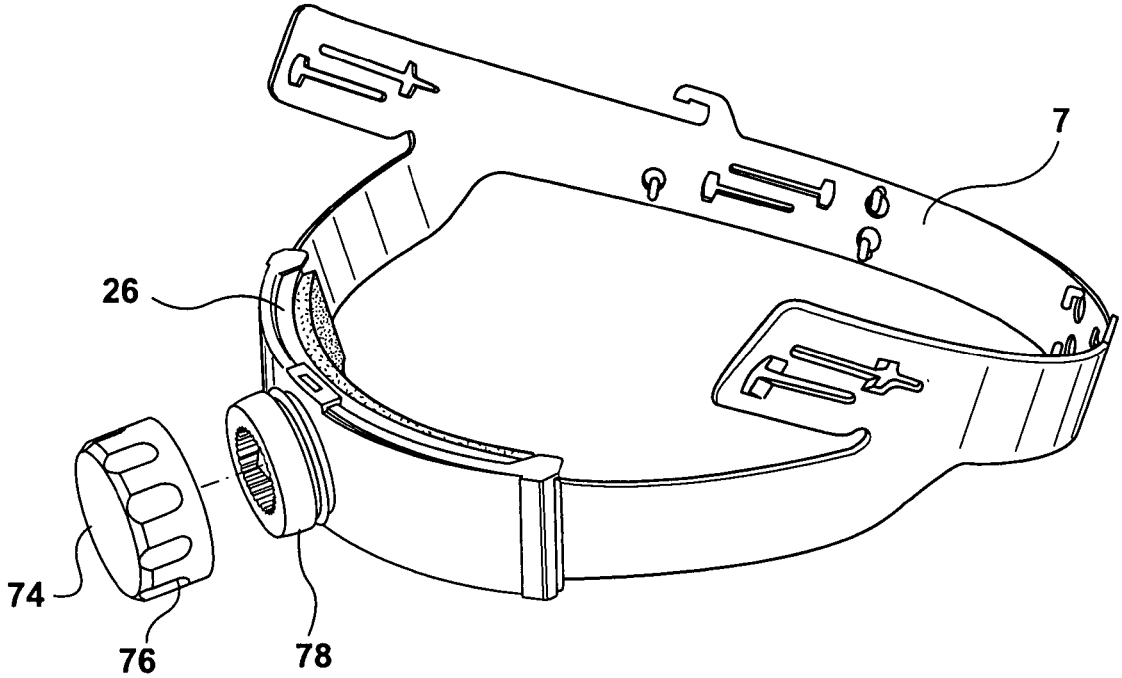
FIG. 15B illustrates an exploded view of FIG. 15A of the modified cap arrangement with the knob off.

In the present invention the cap 10 of the lockable knob 4 when viewed from underneath as illustrated in FIGS. 1, 3, and 6, for example, or in sectional. view FIGS. 8 and 9, has an outer cover which can be grasped by the user for turning. The shape of the cap 10 does not affect the locking mechanism of the invention. In FIG. 1 the outer surface 11 of cap 10 has protrusions which facilitate grasping the knob. In FIGS. 15A and 15B there is a different embodiment illustrated with indentations 76 in the cover which serve, in a different embodiment, the same purpose of facilitating grasping of the knob.

Figure 13B:
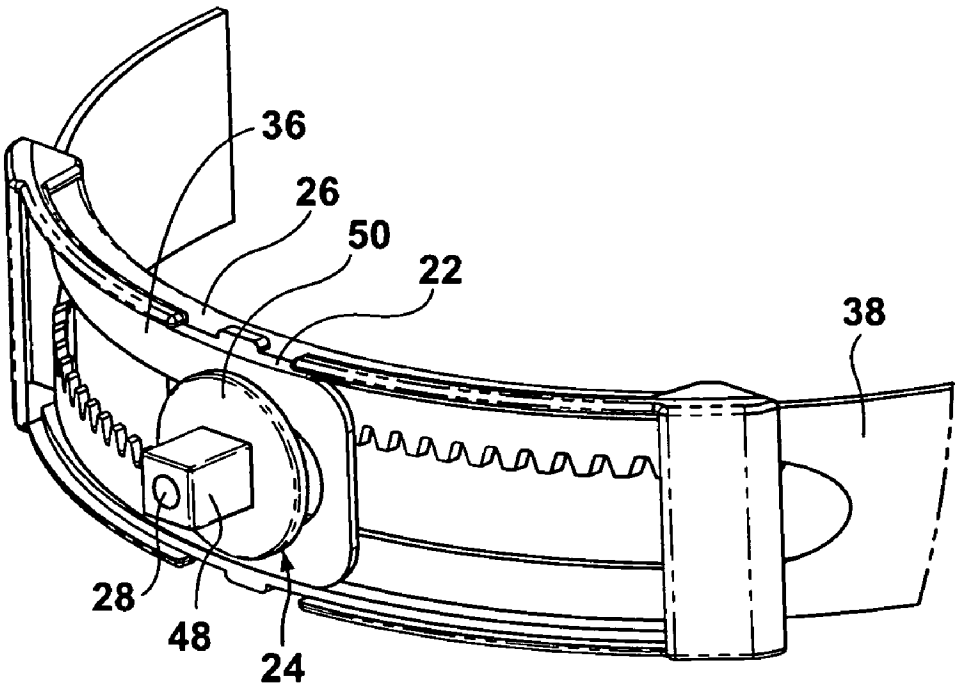
FIG. 13 illustrates a perspective bottom view of a knob or cap 10 of a locking mechanisms, and two racks 36 and 38 with the pinion 28 in position mounted on a support 22 and housing 26 on a headgear suspension.
Figure 13A:
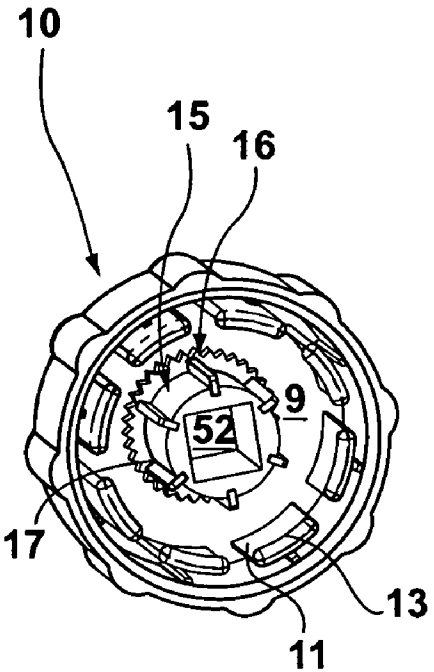
Figure 14A:
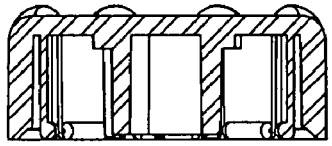
FIG. 14 is an exploded sectional view of an embodiment of the invention illustrating the knob/cap 10, support means 22, driver 24 and housing 26 with pinion 28.
Figure 14B:
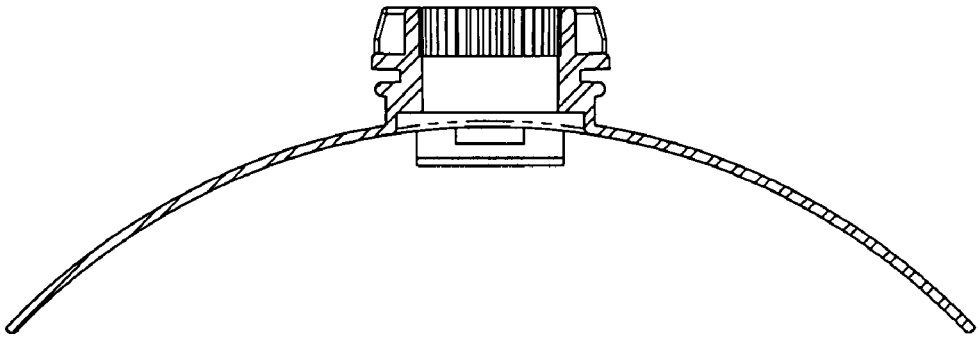
Figure 14C:
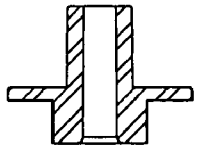
Figure 14D:
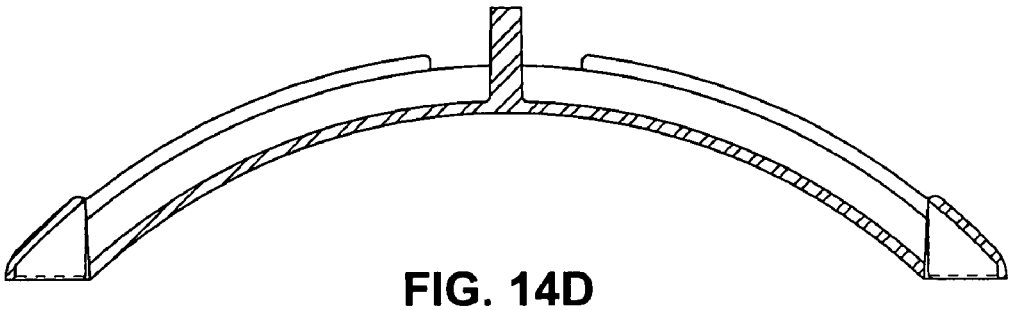

FIGS. 1 and 13 illustrate a bottom plan view of a cap 10 of a lockable knob 4 of the present invention. In the view illustrated in FIG. 13 the cap comprises elements of the locking mechanism of one embodiment wherein there is a radial distribution of resilient arm portions. The arm portions 11 each comprise a lip, or foot 13. The arms 11 extend from the upper surface 9 of the cap 10 and the foot 13 is located on the arm at a position distal from the top surface 9 of the cap.

These feet 13 protrude towards the centre of the cap to form at least one lip.

Figure 2:
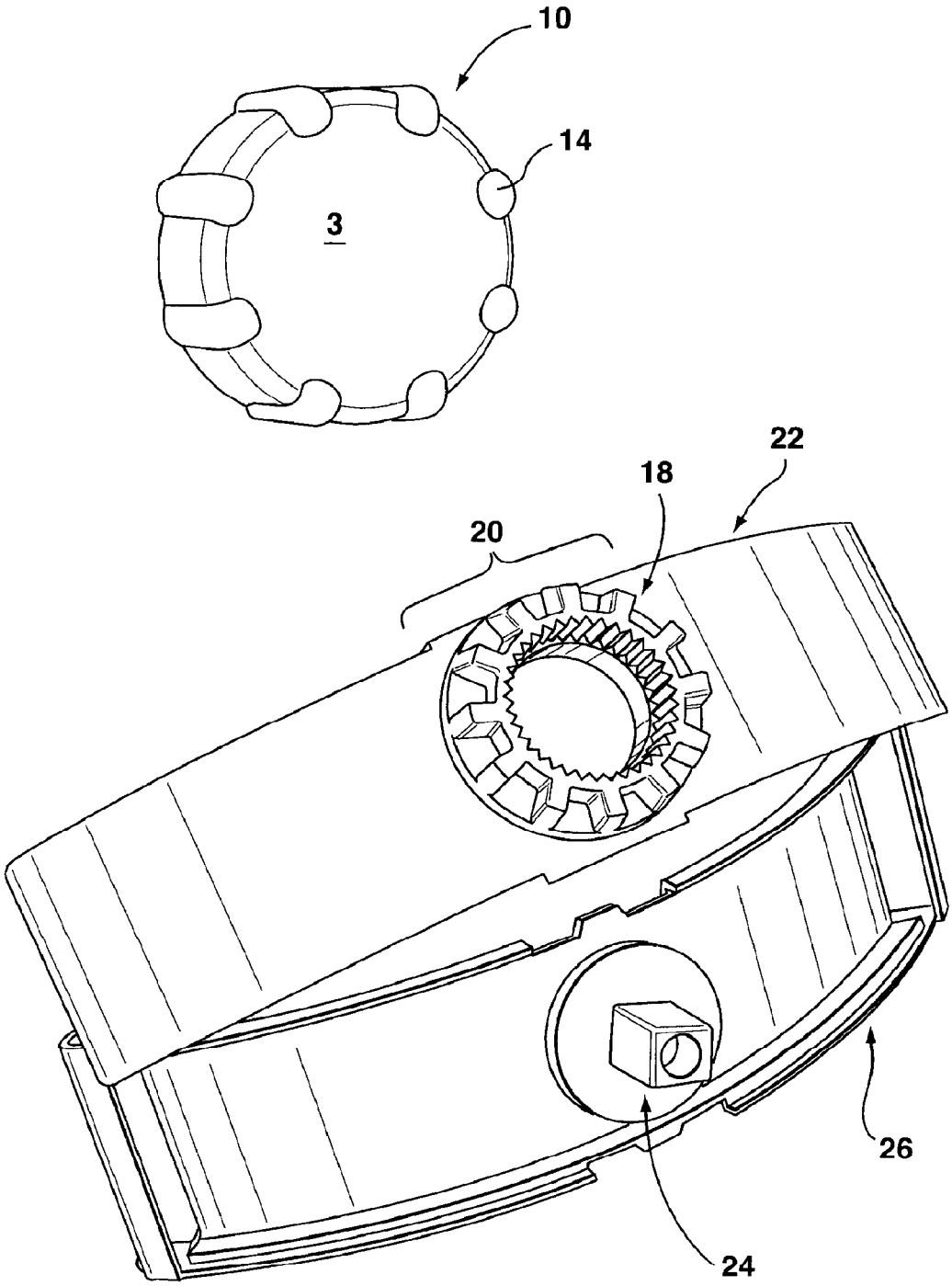
FIG. 2 is a photograph of these parts of an embodiment of the invention showing a top perspective views of a knob or cap 10 portion, a support 22 and a housing 26 for mounting the support, for the locking mechanism of the invention.

FIG. 2 illustrates the cap portion 10 of the lockable knob 4 in top perspective view. The support 22 comprises a head portion 18 (marked generally by bracket 20). The support 22 is mountable in a secure fashion to a housing 26.

FIG. 3 further illustrates the four parts of an embodiment of the present inventive locking mechanism namely: a cap 10, a support 22, a driver 24 and a housing 26.

A pinion 28 is secured to housing 26 and in this embodiment is an integral, fixed part of housing 26.

Drive 24 is rotatably supported on the housing 26. The drive 24 telescopingly receives a drive end 48 of the pinion 28.

It is said the driver telescopingly receives a drive end of a pinion because the driver can move up and down on the pinion.

In the present embodiment of the invention the drive and pinion are always aligned to allow the drive to drive the pinion when the cap is in the unlocked position.

Figure 5:
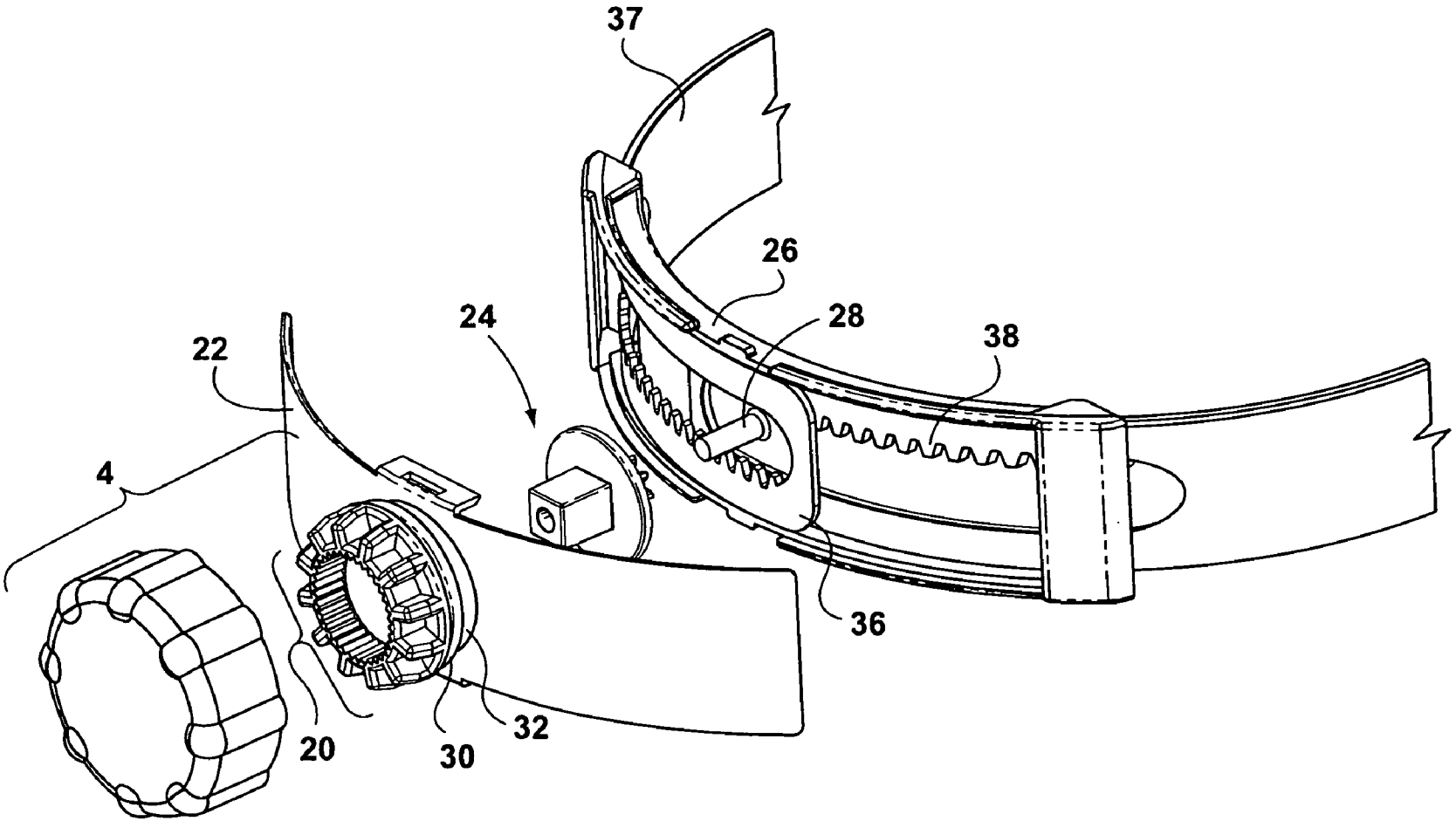
FIG. 5 is an exploded view of a locking mechanism, two racks and partial headgear suspension of an embodiment of the invention.

The exploded view in FIG. 5 illustrates the parts again showing the housing 26 engaged with the racks 36 and 38 and better illustrating the pinion 28 and alignment of the parts.

As illustrated in FIG. 6, the cap 10 fits over the head 20. A central portion 18 defines an opening 31 to receive the drive 24 when in position on head 20.

Figure 10:
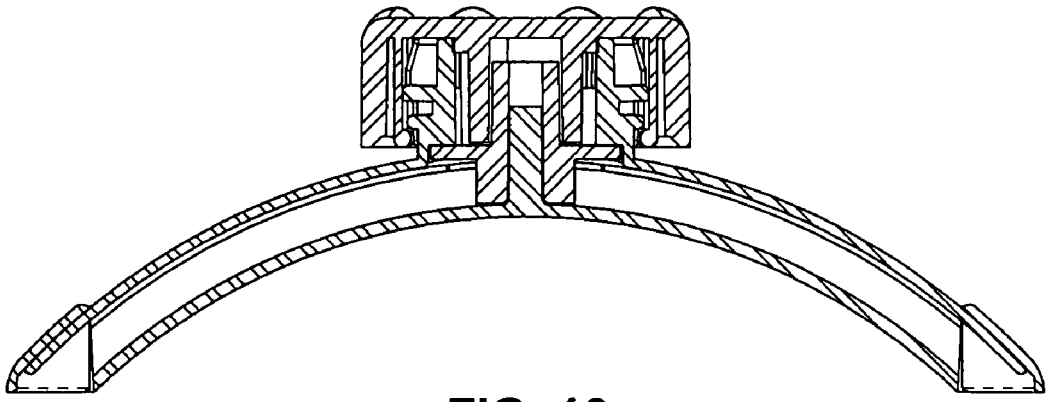
FIG. 10 is a plan section illustrating an embodiment of the invention in a locked or closed position.
Figure 11:
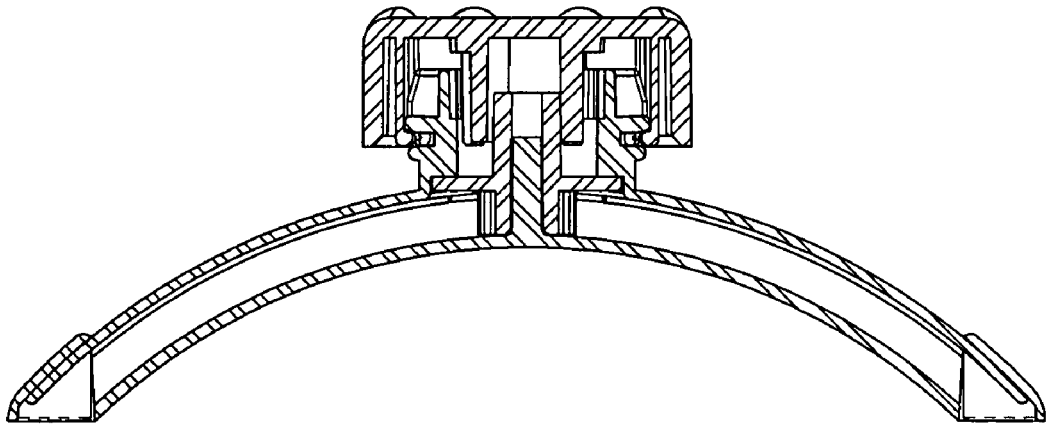
FIG. 11 is a plan section illustrating an embodiment of the invention an unlocked or open position.

FIGS. 8 and 9 and again in FIGS. 10 and 11, cross sectional views of two embodiments of the locking mechanism of the present invention are illustrated in sectional views in both the locked position (FIGS. 8 and 10) and the unlocked position (FIGS. 9 and 11).

A drive 24 is received within an opening 31 in a head portion 18 from one side of a support 22 and the cap 10 fits over the head 20 on the other side of support 22 engaging one end of the drive 24. In the embodiment illustrated the drive 24 has one drive end 48 which extends a length 46 from a round plate 50 on which the gear 42 is mounted. The drive 24 defines an opening 44 there-through to receive the pinion 28.

The length 46 is selected so the drive end 48 of the drive 24 is received in the opening 52 defined in the under surface 9 of the cap 10. This is illustrated in FIGS. 8 and 9, for example, in cross section. The telescoping effect is observed by the change in volume 70 in FIG. 8 (locked position) when compared to the volume 72 in FIG. 9 (unlocked position).

FIG. 9, for example, illustrates an unlocked position for the lockable knob and FIG. 8 illustrates a locked position. As the cap 10 moves from unlocked to locked the drive end 48 telescopes from a first position to a second position and vice versa when the cap 10 moves from locked to unlocked.

The cap 10 is locked on the head portion 20 when at least one lip is resiliently pushed over a radially extending protuberance 62 located on the head 20. In this position the cap 10 is no longer free to move because the ring of teeth 16 located on the inner surface 9 of the cap 10 prevent rotation because movement is restricted by interplay with matching grooves 33 on the inner surface of the head 20. Other mechanisms to fixably engage the cap 10 with the head 20 would work as the head 20 is fixed to a support 22 and does not move in this embodiment When the cap 10 is in the locked position the resilient arms 11 spread apart as the feet 13, which form at least one lip, move over a radial protuberance 60 and when this occurs the cap is prevented from further rotation because the teeth 16 located on the inner surface 9 of the cap (in this embodiment they are centrally located) engage matching grooves 33, on the head 20 and the cap 10 can no longer turn.

When the cap is pulled the feet 13 on the resilient arms 11 are able to move over the radial protuberance 60 as the resilience in the arms 11 allow the arms to splay slightly to overcome the resistance of the protuberance 60. This disengages teeth 16 and permits the cap 10 to freely rotate. The cap 10 does not fall off because the feet 13 are now movably positioned in groove 60 above the protuberance 62. The feet 13 serve to keep the cap 10 in the grooves 60 and 64 respectively located above and below the radially extending protuberance 62 on the head 10.

Figure 7:
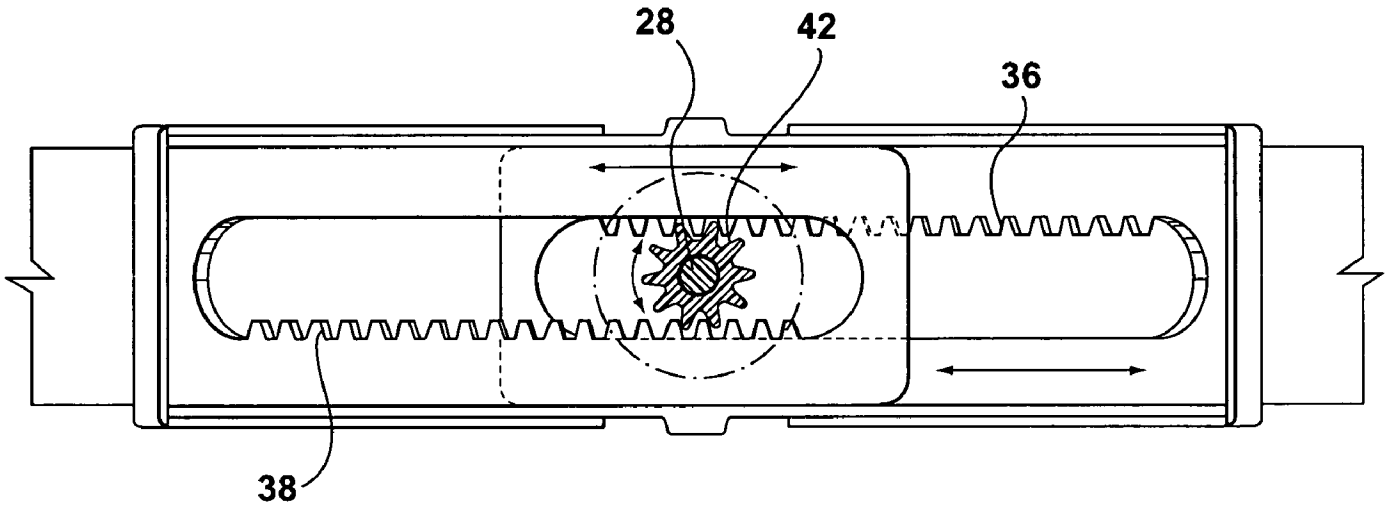
FIG. 7 is a diagrammatical view of an embodiment of the invention illustrating the cog and pinion in section as well as the cog engaging the teeth of the two racks mounted on a headgear suspension illustrated in cut away.

FIG. 7 illustrates in diagrammatical format the gear teeth 42 engaged with the teeth of the rack. As the gear rotates along the pinion 28 driven by the drive this is translated into movement of the two racks 36 and 38 secured at either end of a suspension strapping.

Figure 12A:
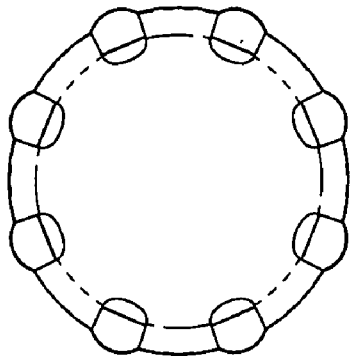
FIG. 12A illustrates a top plan view, of an embodiment of a knob or cap of the locking mechanism of the present invention.
Figure 12B:
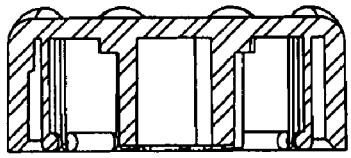
FIG. 12B illustrates a sectional view of the knob along line HH of FIG. 12A.
Figure 12C:
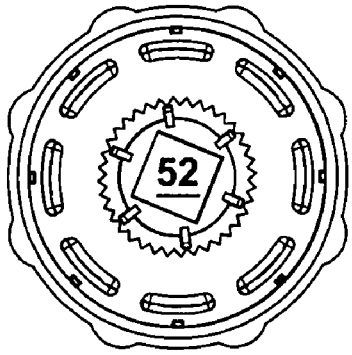
FIG. 12C illustrates a bottom plan view of the knob.

FIG. 12B illustrates a cross section along line H-H of one embodiment of the cap 10 of FIG. 12A. FIGS. 12A and 12B illustrates top plan and bottom plan views respectively.

FIG. 13 illustrates the housing and support assembled in position over the two racks 36 and 38 with the driver 24 in position. The drive plate 50 to which the gears 42 are attached below (not shown in FIG. 13) and the extending drive end portion 48 with an opening (not shown) therein to receive the pinion 28. The head portion is not shown in FIG. 13. The undersurface 9 of cap 10 is illustrated and the square shaped opening 52 to receive the similarly shaped drive end portion 48 is illustrated. The material 15 defining the opening 52 is shown having a height 17 to telescopically receive the length 46 of the drive end portion 48.

FIG. 14 further illustrates the parts in cross section, including the cap 10 of the lockable knob and the head 20 of the lockable knob affixed to a support 22.

FIG. 14 also illustrates a drive 24 with an opening therethrough to receive a pinion 28 affixed to housing 26.

Figure 4:
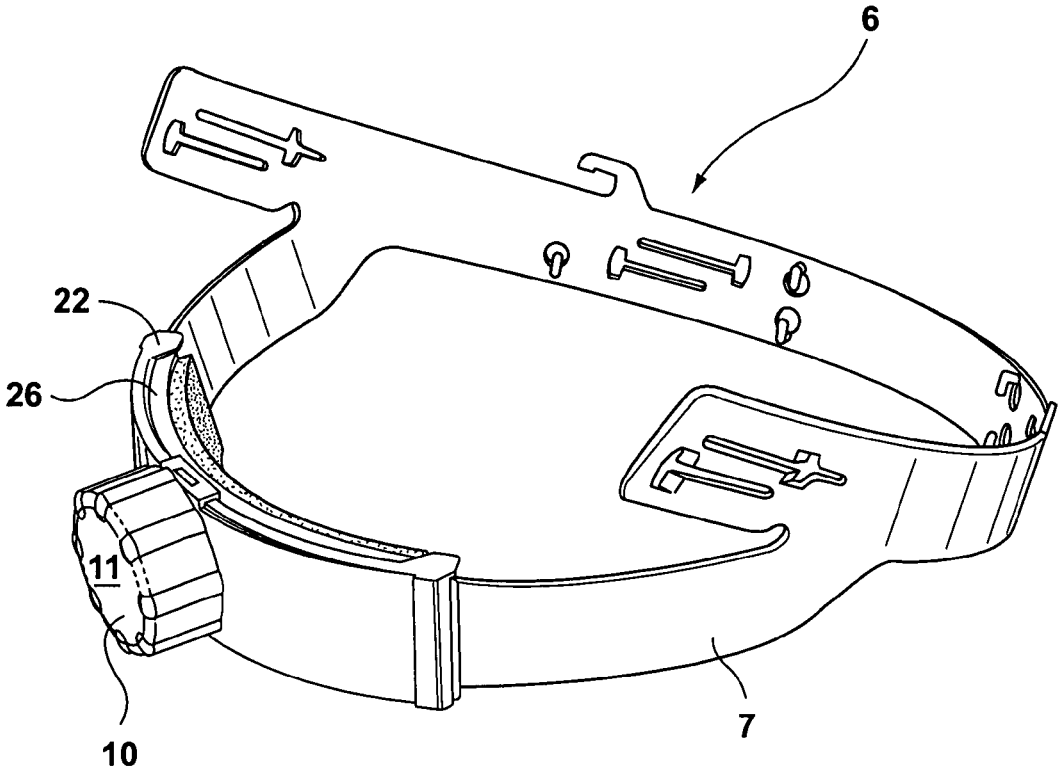
FIG. 4 is a first embodiment in assembled perspective view illustrating an embodiment of a locking mechanism of the invention, in a locked position, attached to a headgear suspension.

FIG. 4 is a perspective view of the entire suspension with the locking mechanism of the present invention in place and in a locked position. The suspension strapping 7 (available commercially) receives inserts for racks 36 and 38 which can be molded to the strapping. The locking mechanism of the current invention can be used with any suspension strapping so long as the appropriate rack inserts can be secured to the ends of the strap.

The locking mechanism of the current invention can be sold separately to manufacturers for use with a wide variety of types and sizes of suspension strapping for various purposes including visors and helmets.

The locking mechanism of the present invention could be sold as a kit comprising the four parts illustrated, for example, in FIG. 3, parts 10, 22, 24 and 26 either separately or in various combinations or alone.

The support may comprise a means to snap on to the housing.

Foam rubber padding may be provided for on the side of the housing which abuts the user's forehead, for comfort.

The method, kit, lockable knob and suspension of the present invention permit users to use one hand to readily unlock, adjust and re-lock a suspension for headgear.

Other features, embodiments, and equivalents would be known to a person skilled in the art and are part of the invention as defined by the claims and description of this specification.

What is claimed is:

1. A lockable knob, comprising:

a support;

a knob rotatably mounted on said support;

one of said knob and said support having a radially directed protuberance and another of said knob and said support having a resilient portion which is resiliently deflected over said protuberance when said knob is axially displaced from a first axial position whereat said resilient portion is on one side of said protuberance to a second axial position where at said resilient portion is on an opposite side of said protuberance;

said support having a locking feature;

said knob having a complementary locking feature for locking to said support locking feature when said knob is in said first axial position, whereby said knob is rotatable only when in said second axial position.

2. The knob according to claim 1 wherein said first and second axial positions are restricting movement along a first and second groove respectively.

3. The knob according to claim 2 wherein said knob further comprises a cap rotatably mounted on a head portion affixed to said support.

4. The knob according to claim 3 wherein said complementary locking feature comprises teeth on said knob cap which engage immovable grooves on said head portion.

5. The knob according to claim 4 wherein said resilient portion comprises at least one arm extending from an undersurface of said cap.

6. The knob according to claim 5 wherein said at least one arm comprises a foot extending inwardly at an end of said at least one arm distal from a point of attachment of said at least one arm to said cap undersurface.

7. A kit comprising a lockable knob, a housing, and a gear drive, said lockable knob comprising, a support;

a knob rotatably mounted on said support;

one of said knob and said support having a radially directed protuberance and another of said knob and said support having a resilient portion which is resiliently deflected over said protuberance when said knob is axially displaced from a first axial position whereat said resilient portion is on one side of said protuberance to a second axial position whereat said resilient portion is on an opposite side of said protuberance;

said support having a locking feature;

said knob having a complementary locking feature for locking to said support locking feature when said knob is in said first axial position, whereby said knob is rotatable only when in said second axial position;

said housing comprising a pinion extending within said housing and meshing with a rack at either overlapping end of a suspension within said housing; a driver rotatably supported on said housing and telescopingly receiving a drive end of said pinion; said driver having a complementary locking feature for locking to said support locking feature.

8. A method for adjusting and locking a headgear suspension, the method comprising the steps of:

i) providing a lockable knob, comprising: a support; a knob rotatably mounted on said support; one of said knob and said support having a radially directed protuberance and another of said knob and said support having a resilient portion which is resiliently deflected over said protuberance when said knob is axially displaced from a first axial position whereat said resilient portion is on one side of said protuberance to a second axial position whereat said resilient portion is on an opposite side of said protuberance; said support having a locking feature; said knob having a complementary locking feature for locking to said support locking feature when said knob is in said first axial position, whereby said knob is rotatable only when in said second axial position;

ii) unlocking said headgear suspension by pulling the knob to deflect said resilient portion over said protuberance to axially displace said knob from a first axial position on one side of said protuberance to a second axial position whereat said resilient portion is on an opposite side of said protuberance permitting free rotation of said resilient portion in said second axial position but not in said first axial position.

* * * * *